US006540579B1

(12) United States Patent
Gubitosi et al.

(10) Patent No.: US 6,540,579 B1
(45) Date of Patent: Apr. 1, 2003

(54) CONVERTIBLE ACTIVITY TOY

(75) Inventors: Domenic T. Gubitosi, East Aurora, NY (US); Seth P. Frankel, Culver City, CA (US); Christopher D. Cimerman, Clarence Center, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/855,692

(22) Filed: May 16, 2001

(51) Int. Cl.[7] ..... A63H 33/00

(52) U.S. Cl. ..... 446/227; 446/487; 472/135; 297/118; 297/136

(58) Field of Search ..... 446/227, 487, 446/478; 472/135; 297/DIG. 11, 141, 136, 137, 118

(56) References Cited

U.S. PATENT DOCUMENTS

| | | | | |
|---|---|---|---|---|
| 631,889 | A | * 8/1899 | Friedersdorff | 280/87.05 |
| 1,059,908 | A | * 4/1913 | Root | 297/125 |
| 2,917,864 | A | 12/1959 | Payne | |
| 4,208,831 | A | 6/1980 | Strauss | |
| 4,551,114 | A | 11/1985 | Hyman et al. | |
| 4,731,024 | A | 3/1988 | Kavanagh | |
| 4,973,286 | A | 11/1990 | Davison | |
| 5,076,520 | A | 12/1991 | Bro | |
| 5,154,658 | A | 10/1992 | Marcus | |
| 5,254,007 | A | 10/1993 | Eagan | |
| 5,441,289 | A | * 8/1995 | Spielberger | 135/67 |
| 5,478,268 | A | 12/1995 | Au | |
| 5,732,999 | A | 3/1998 | Petrie | |
| 5,733,165 | A | 3/1998 | Kelley | |
| 5,924,942 | A | 7/1999 | Gentile | |
| 5,934,747 | A | 8/1999 | Garland | |
| 6,000,750 | A | 12/1999 | Rossman et al. | |
| 6,027,395 | A | 2/2000 | Strom | |
| 6,053,792 | A | 4/2000 | Sallee et al. | |
| 6,066,022 | A | 5/2000 | Fobean et al. | |

OTHER PUBLICATIONS

One Step Ahead Summer 2000 catalog, 3 pages.

GracoBaby.com, Product Catalog, "2–in–1 Convertible Activity Center," Nov. 6, 2000.

GracoBaby.com, Product Catalog, "Bouncing Entertainer," Nov. 6, 2000.

GracoBaby.com, Product Catalog, "Rocking Base Entertainer," Nov. 6, 2000.

* cited by examiner

*Primary Examiner*—Jacob K. Ackun
(74) *Attorney, Agent, or Firm*—Cooley Godward LLP

(57) ABSTRACT

A convertible activity toy for promoting gross motor development in children includes a base receivable on a supporting surface and a top coupled to the base. The top includes a first portion and a second portion whereby the first portion is movable from a substantially coplanar orientation relative to the second portion to a substantially non-coplanar orientation relative to the second portion. The top and base define an opening and an interior space so that an infant can crawl through the opening into the interior space when the top is in the substantially coplanar orientation or so that the child may walk the opening and into the interior space or a portion thereof when the top is in the substantially non-coplanar orientation. The top includes activity items that are attractive to an infant and encourages the infant to reach up to the top by pulling up from a seated position to a standing position using handles or grips disposed on the toy. The toy also includes sensory output generators configured to encourage the infant to pull up using the handles or grips to reach the activity items. The convertible feature of the present invention allows the toy to be attractive to both an infant and a toddler and directly encourages and enables the infant to make the transition from crawling to standing.

55 Claims, 7 Drawing Sheets

CONVERTIBLE ACTIVITY TOY

BACKGROUND

1. Field of the Invention

The present invention relates generally to toys, and more particularly, to a convertible activity toy for promoting gross motor development in children.

2. Discussion of Related Art

Children's activity toys, particularly activity play centers, such as bouncer-type activity centers or stationary play tables, have been known in the art. Moreover, toys employing various types of runways, chutes, or other similar structures have been provided for balls, marbles, toy cars, and the like. These toys appeal to young children, particularly infants, because they enjoy watching the balls or other objects descend along or through the structures.

One known toy comprises a walker toy including a tray, a seat in the middle of the tray and wheels rotatably mounted to the assembly. Such devices have been popular for many years. Due to the difficulties that a child freely mobilized on wheels can present to parents, the recent trend in activity centers has been to create devices that do not have wheels so as to restrict the movement of a child seated therein.

A variety of different stationary play centers are known in the art. These stationary devices are typically similar to the prior walker-type devices, with the exception that they are mounted on legs rather than wheels, or alternatively they are mounted on rocking assemblies which provide for rocking movement, yet do not allow full mobility. In these conventional play centers, a child generally sits in a rotatable seat assembly, which is rotatable relative to the body portion for added play value, and such that a child seated in the seat can reach and play with toys placed on the surrounding play surface. The toys are generally geared to sensory stimulation. The leg assemblies are adjustable in height to provide different height settings as the child grows. Moreover, in order to accommodate the child's changing needs over the first several years of its life, these conventional play centers have incorporated characteristics and features which allow the configuration of the play center to change with the child's development, for example, transitioning from crawling to standing.

One known activity center is convertible between a bouncer-type stationary seat configuration and a play table configuration. The center includes a tray-shaped body portion and a plurality of adjustable leg assemblies pivotably mounted to the body portion for supporting the body portion in a stationary position on a supporting surface. The center further includes a removable seat assembly, which can be selectively mounted within the central opening to provide a bouncer-seat configuration. When the child reaches a standing or walking stage of development, the activity center can be converted into a table configuration. This is accomplished by removing the seat assembly from the central opening and mounting a planar table top insert within the central opening to provide a continuous planar play surface on the top of the body portion. In order to play with objects located on the planar play surface, a child must walk around the outside perimeter of the table.

Another example, of a conventional activity center, which is convertible between a bouncer configuration and a play center configuration, includes a circular tray-shaped body portion, a plurality of adjustable legs, and a saucer-shaped base portion. The tray-shaped body portion comprises two interlocking and rotatable sections so that the tray-shaped sections can be rotated within a common plane so that the activity items are disposed at a common level about the base. In the bouncer-seat configuration, the toy acts as a stationary walker whereby an infant can sit in a removable and rotatable seat assembly and interact with a plurality of toys disposed about the tray-shaped body portion. As the child grows, the center bouncer seat can be removed and the tray-shaped body portion can be rotated open to provide a play center for toddlers.

A problem with conventional toys is that although they have been configured to accommodate a child's development, for example, transitioning from sitting to standing, they have failed to actively promote this development. In such conventional toys, the toys or other activity items have all been provided on the same tray-shaped body portion, which has generally been formed in a planar configuration. For example, in the bouncer seat configuration, the infant rotates the seat to play with the toys disposed about the tray-shaped body portion. To accommodate the child's growth, conventional toys have been convertible to play tables or other one-level activity centers. In these configurations, the toddler may play with the toys disposed on the tray-shaped body portion. But these toys have generally been disposed in the same planar orientation with respect to each other. Thus, these conventional toys have not actively promoted the child's development of gross motor skills, such as transitioning from sitting to standing. As the design of toys has progressed, however, parents, teachers, and other individuals involved in child-care have sought and/or demanded toys that not only accommodate a child's growth but in addition, provide a direct stimulus to the child's development.

SUMMARY OF THE INVENTION

In light of the above-identified demands, there is a need for an improved approach that incorporates visual or audible attractions disposed in multiple planar configurations, such as descending objects, lights, sounds, or the like while at the same time providing an incentive for the child to physically interact with the device. The better approach would be designed to allow an infant to crawl into an interior of the toy to interact with the activity items while at the same time being designed to allow conversion into a multi-planar activity center for toddlers. The better approach would also be designed to support the child's body weight and incorporate means such as grips or handles to allow the child to pull up from a seated position to a standing position to play with the device. This combination of visual, audible, and physical interaction with the toy at multiple planar configurations would aid in the promotion of gross motor development, especially for infants, while at the same time provide an entertaining device to be used for a prolonged period of time by toddlers. The nature of the operation of such a toy would require coordination of the eyes, hands, and body that could also have applicability in physical therapy for small children.

Thus, there is a need in the art for a toy that substantially obviates the limitations and disadvantages of conventional toys. Particularly, there is a need for a toy that provides for visual, audible, and physical interaction with the toy at multiple planar configurations and that aids in the promotion of gross motor development.

The present invention solves the problems with, and overcomes the disadvantages of, conventional toys. In particular, the present invention relates to a toy that provides for visual, audible, and physical interaction with the toy at multiple planar configurations and that aids in the promotion of gross motor development.

The invention includes a base receivable on a supporting surface and a top coupled to the base. The top preferably includes a first portion and a second portion whereby the first portion is movable from a substantially coplanar orientation relative to the second portion to a substantially non-coplanar orientation relative to the second portion. The top preferably has a substantially circular configuration such that the first portion forms an arch when the first portion is moved to the substantially non-coplanar orientation. The invention also includes an activity item, or a plurality of activity items, disposed on one or both of the base and the top. The top and the base preferably define an opening and an interior space proportioned to accommodate a child. The child may crawl through the opening and into the interior space when the top is in the substantially coplanar orientation or so that the child may walk through the opening and into the interior space or a portion of the interior space when the top is in the substantially non-coplanar orientation. The child may interact with one or more of the activity items disposed on the base or the top when the child is in the interior space.

In another aspect, the invention includes a support coupled to the base and the top whereby the base, the top, and the support define an interior space and an opening proportioned to accommodate a child. The invention also preferably includes a pathway defined by the base for guiding an object from an upper end of the base to a lower end of the base. The top also preferably includes an opening in communication with the pathway. The invention also preferably includes a sensory output generator and an actuator operatively coupled to the sensory output generator and operable to initiate operation of the sensory output generator. The sensory output generator also provides visual or audible stimulation to reward the child as the child interacts with the toy.

DETAILED DESCRIPTION

Figure 1:
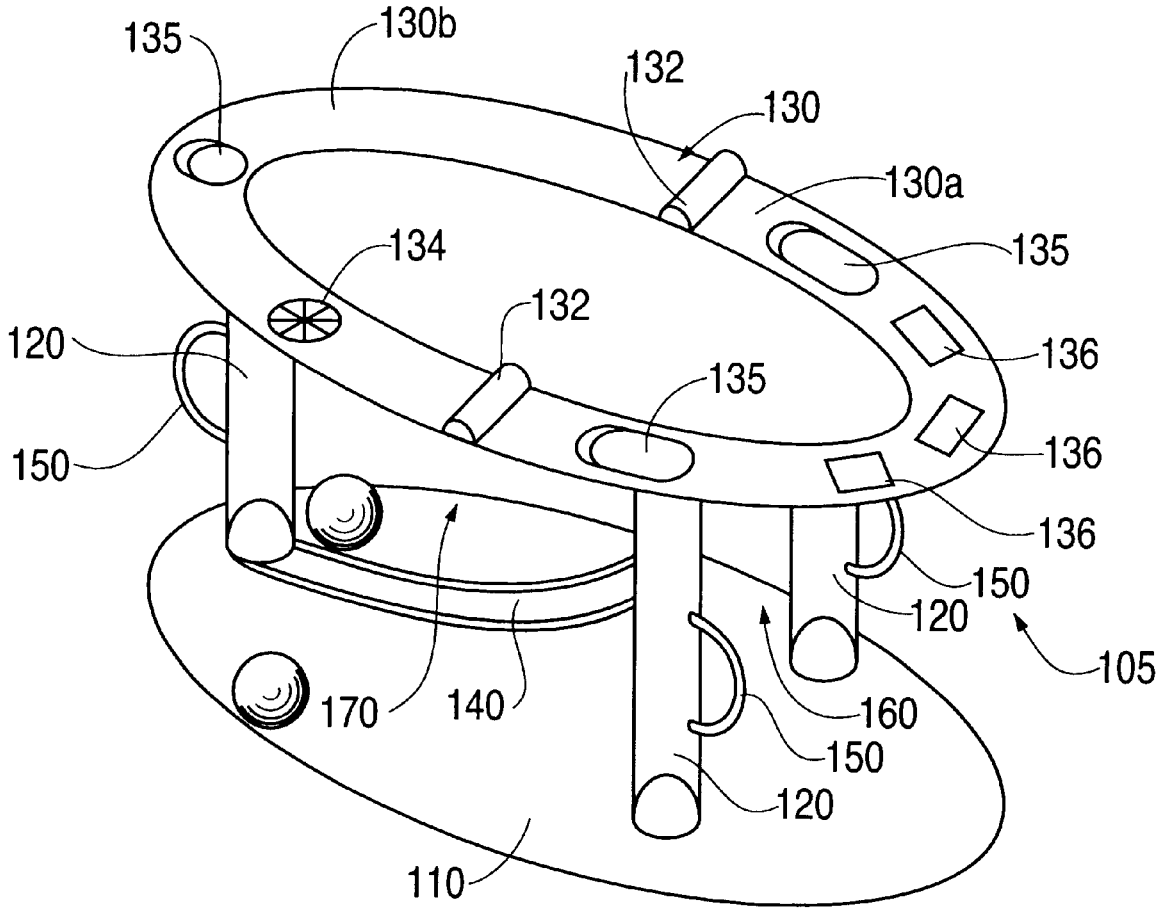
FIG. 1 is a perspective view of one embodiment of a toy embodying the principles of the present invention.

A toy 105 schematically illustrating the general principles of the present invention is shown in FIG. 1. The toy 105 includes a base 110, which can include a support or plurality of supports 120, a top 130, and a track 140. Base 110 is designed and constructed to be receivable on a supporting surface, such as the floor. Base 110 is also configured to provide stability to the toy 105 to support the weight of an infant or other small child while the infant is interacting with the toy 105 in a manner which will be described in more detail below. In one embodiment, base 110 can include a single support or a plurality of supports 120 coupled thereto. In another embodiment, support or plurality of supports 120 can be considered separate elements that are coupled to base 110. Supports 120 preferably extend between and are coupled to base 110 and top 130. In an alternative embodiment, supports 120 are coupled to base 110 and top 130 rests upon support 120. Supports 120 are also dimensioned and constructed to support the top 130 and to provide structural stability to support the weight of an infant or other small child.

Top 130 is preferably disposed at the upper end of support or plurality of supports 120. In preferred embodiments, top 130 is constructed with a first portion 130*a* and a second portion 130*b*. The first portion 130*a* is movable or rotatable about a lockable pivot assembly 132 from a first or substantially coplanar orientation relative to the second portion 130*b* (as shown in FIG. 1) to a second or substantially non-coplanar orientation (not shown) relative to the second portion 130*b*. An activity item 134 is disposed on top 130. Activity item 134 can include a button, spinning disc, rotating ball, or other similar toy designed to stimulate the senses of a child. In an alternative embodiment, an activity item 134 can be disposed on support 120, base 110, or both. It should be understood that any number of activity items 134 may be disposed on top 130, support 120, and base 110. Each of these activity items 134 provides an incentive to an infant or small child to interact with the toy 105.

A track or pathway 140 is disposed on base 110, support 120, or both base 110 and support 120. Track or pathway 140 extends between top 130 and base 110 and preferably comprises a plurality of track sections. Track 140 is preferably coupled to support 120 and/or base 110, but track 140 could be formed in a free-standing or similar well-known configuration. In preferred embodiments, track 140 is arranged to convey an object from the top 130 to the base 110, at least partially outside support 120, and thereafter to the supporting surface.

The toy 105 also preferably includes a plurality of grips or handles 150 disposed above the base 110 and at or below the top 130 (such as on support 120, the top 130, and/or the track 140). Grips 150 can be formed in any well-known manner or shape to allow an infant or other small child to easily grasp the grips 150 while interacting with the toy 105. In preferred embodiments, the grips 150 are arranged to allow an infant user to grasp grips 150 to pull up from a seated position to a standing position either within or beside toy 105 whereby the infant can interact with the activity items 134. The grips 150, along with the base 110, support 120, top 130, and track 140, sustain the weight of the infant while the infant is pulling up into the standing position and provide a stable support for the infant while in the standing position.

Base 110 and/or supports 120 preferably include a plurality of passageways formed therein for guiding an object. Supports 120 include passageways formed therein in communication with track or pathway 140. In an alternative embodiment, the passageways could extend along the entire length of support 120 to allow an object to travel from the upper end of the support 120 to a lower end thereof. A number of openings 135 are disposed in top 130 and configured to allow an object to pass through openings 135. Openings 135 are also preferably in communication with the passageways formed in supports 120. Top 130 also preferably includes at least one sensory output generator 136, for example, a light, speaker, or other similar device which adds to the infant user's enjoyment of toy 105 and rewards the infant for interacting with the activity items 134.

Top 130, base 110, and support 120 define an opening, shown generally at 160, and an interior space, shown generally at 170. Each of opening 160 and interior space 170 is proportioned to accommodate a young child or infant. A child may crawl through opening 160 when top 130 is in the substantially coplanar or substantially horizontal orientation into the interior space 170 and interact with the activity items disposed around the lower regions of the toy 105. Alternatively, a child or toddler may walk through opening 160 and into the interior space 170 or a portion of the interior space 170 when top 130 is in the substantially non-coplanar or substantially vertical orientation. When top 130 is in the substantially non-coplanar or substantially vertical orientation, not only can the toddler interact with the activity items disposed at the lower regions of the toy 105, but it can also interact with the activity items 134 disposed on top 130 which has formed a substantially arched configuration, which will be described in more detail below. This dual planar orientation of activity items provides an enhanced play feature for the walking toddler. Therefore, the convertible feature of the present invention allows the toy 105 to be attractive to both an infant who is learning to crawl and a toddler who has made the transition from crawling to walking. Moreover, because of its construction and the provision of grips or handles 150 along with the plurality of activity items 134, an infant is directly encouraged and enabled to make the transition from crawling to standing.

An exemplary implementation of a toy embodying the principles of the invention illustrated in FIG. 1 is shown in FIGS. 2–5. The toy 205 includes a base 210, a support 220, a top 230, and a track 240.

The base 210 includes a planar surface 212 that is receivable upon a supporting surface, such as the floor, for example. In preferred embodiments, base 210 includes support 220 formed thereon, which includes a plurality of vertical columns 222 extending upwardly from the lower end of base 210. It should be apparent, however, that support 220 could be formed separately and coupled to base 210. For ease of reference, base 210 and support 220 will be referred to separately herein below.

Figure 2:
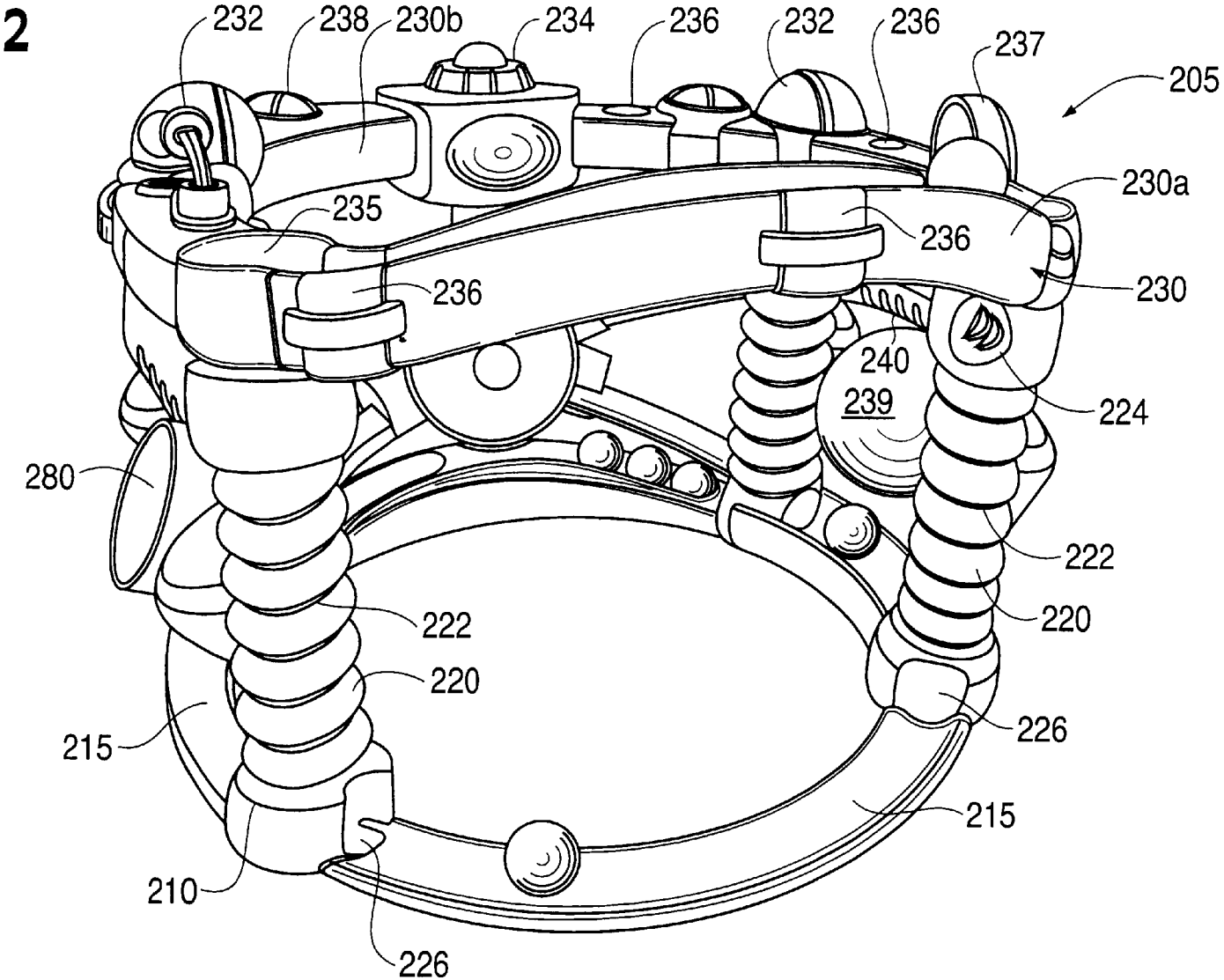
FIG. 2 is a perspective view of a second embodiment of a toy embodying the principles of the present invention.
Figure 3:
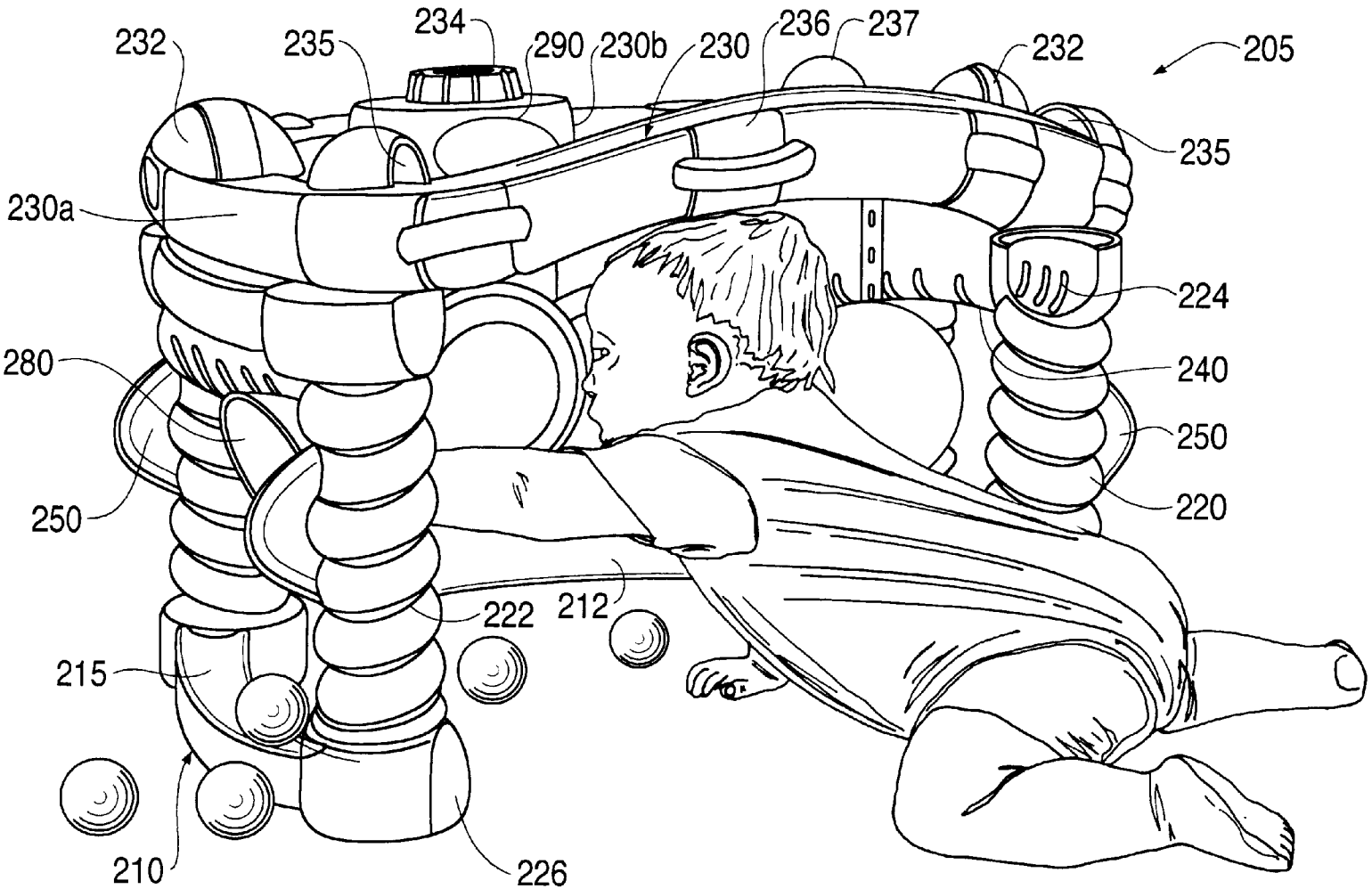
FIG. 3 is a perspective view of the toy of FIG. 2 with the first portion of the top shown in a first configuration.

Base 210 includes a ramp section or pathway 215 for guiding an object. Ramp section 215 is coupled to and in communication with track or pathway 240, which will be described in more detail below. Ramp section 215 can be formed integrally with base 210 or may be formed separately and coupled to base 210 using any well-known fastening method. In preferred embodiments, ramp section 215 is configured to permit an object to travel along a portion of base 210 and thereafter onto the supporting surface, as shown in FIG. 3. Alternatively, ramp section 215 and base 210 are configured to extend in a generally circular configuration along the supporting surface as shown in FIG. 2. It should be apparent that in another embodiment an object, such as a ball, could drop through the toy directly onto the floor.

Support 220 includes a plurality of columns 222 formed integrally with base 210. Columns 222 are coupled together at their upper end by a track or pathway section 240 formed integrally as part of support 220. It should be apparent that columns 222 can be coupled together in any well-known manner. At least one of columns 222 includes an opening 224 formed in the upper end thereof and in communication with one end of the track or pathway section 240. Opening 224 is dimensioned to provide a pathway for an object from the opening 224 onto the track 240, which will be described in more detail below. At least one of the columns 222 also includes an opening 226 formed at the lower end thereof and in communication with the ramp or pathway 215 formed on base 210 to allow passage of an object from the ramp 215 to the supporting surface (FIGS. 3–5), or, alternatively, continue onto a front portion of ramp 215 on base 210 (FIG. 2).

Figure 5:
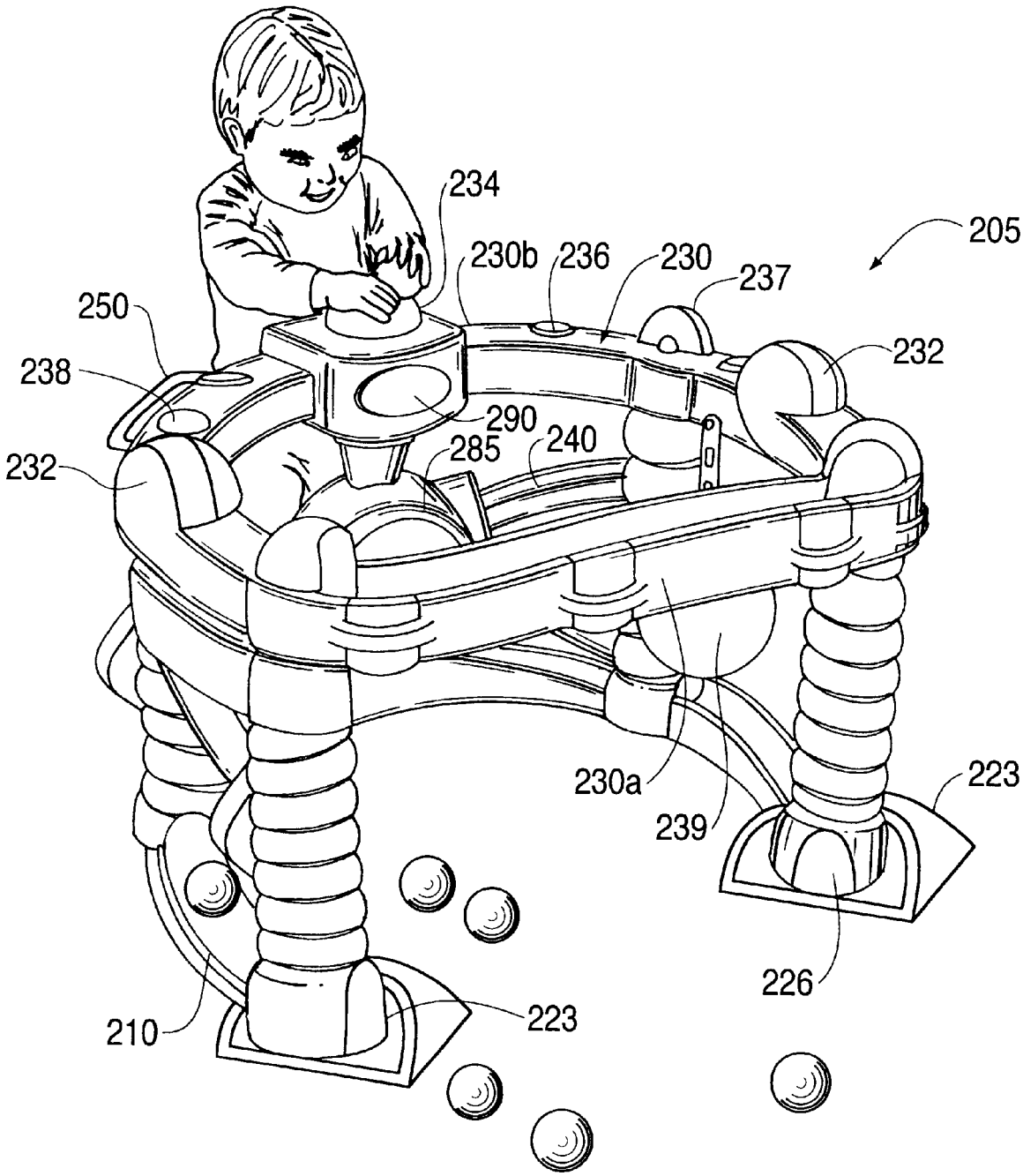
FIG. 5 is an additional perspective view of the toy of FIG. 3.

Support 220 is dimensioned and constructed to support the top 230 and to provide structural stability to support the weight of an infant or other small child. In preferred embodiments, support 220 also provides structural stability to the track 240. In preferred embodiments, a support structure 223 is coupled to a lower end of support 220, and specifically a lower end of support columns 222. Support structure 223 provides additional stability to the base 210, support 220, and top 230. In preferred embodiments, support structure 223 is configured with a triangular shape or a hemispherical shape but triangular is preferred. It should be apparent that support structure could be formed in any suitable shape. In addition, it is preferred that two support structures 223 be employed as shown in FIG. 5. A rotatable mirror assembly 280 is also preferably disposed on the support 220.

In one embodiment, a plurality of grips or handles 250 are disposed on the support columns 222. It should be understood, however, that in alternative embodiments the toy could be provided without grips 250. Grips 250 can be formed in any well-known manner or shape to allow an infant or other small child to easily grasp the grips 250 while interacting with the toy 205. In preferred embodiments, the grips 250 are arranged to allow an infant user to grasp grips 250 to pull up from a seated position to a standing position either within or beside toy 205 whereby the infant can interact with the plurality of activity items disposed on the toy 205.

Figure 4:
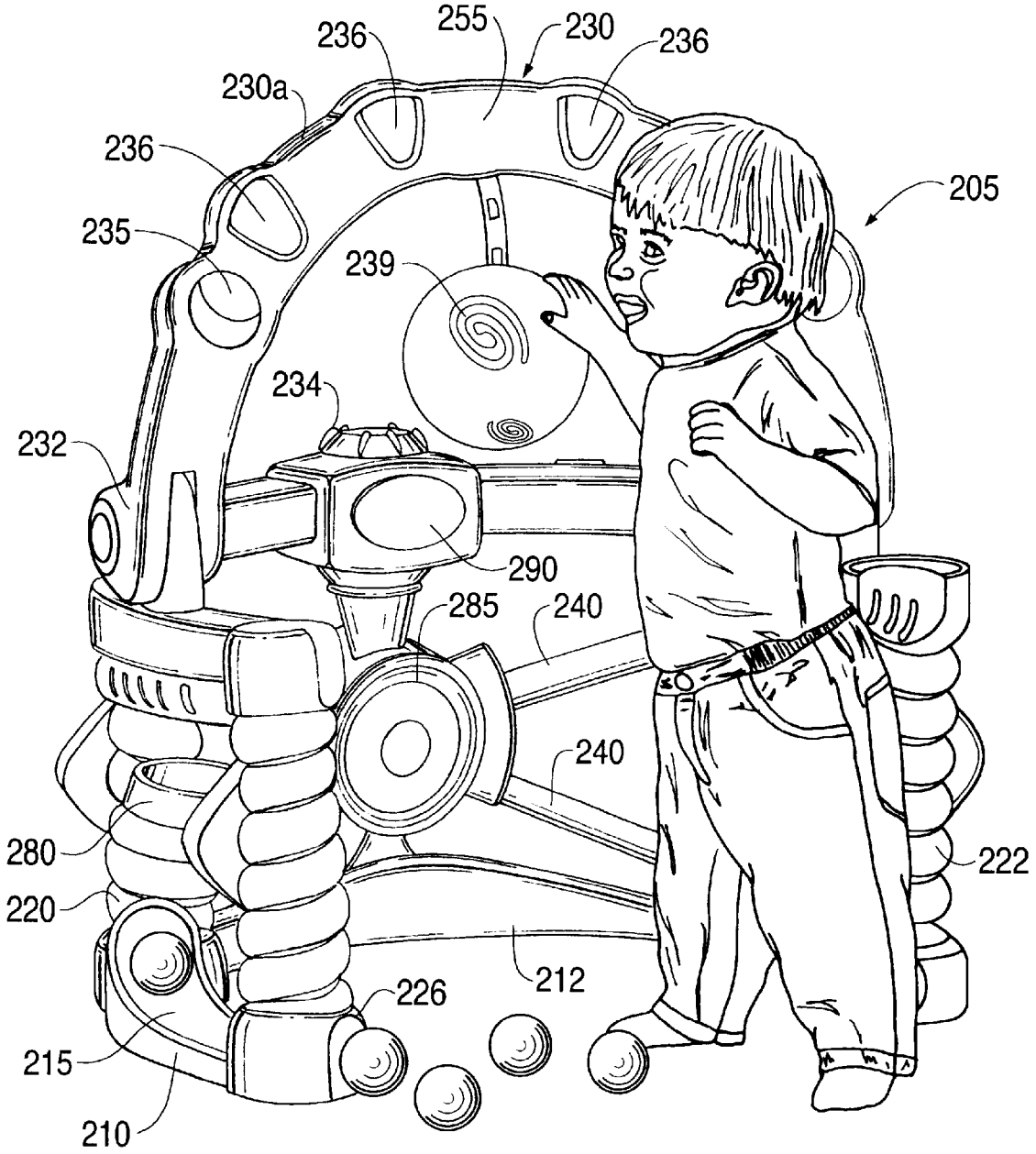
FIG. 4 is a perspective view of the toy of FIG. 2 with the first portion of the top shown in a second configuration.

Track or pathway 240 is preferably disposed between the top 230 and the base 210. Track 240 is preferably composed of a plurality of interconnecting track sections as best seen in FIG. 4. Each of track sections includes an outer wall, an inner wall, and a bottom forming a channel or pathway for an object, for example, a ball, to descend from the top 230 to the base 210, and thereafter, preferably to the supporting surface (FIG. 4), or alternatively, to the extended base 210 (FIG. 2).

Each of the track sections of track 240 is preferably coupled to an exchanger 285, as shown in FIG. 4. Exchanger 285 is formed with internal passageways that allow the objects, such as balls, to freely pass from one track section to the other. The exchanger 285 preferably includes graphical features formed therein or disposed thereon. These graphical features can be in the form of an emblem or a sticker depicting an animated face, symbols, or the like. In preferred embodiments, the exchanger 285 includes a graphical depiction of an animated face with a nose that spins freely about an axis thereby adding to the child user's enjoyment of the product.

The top 230, as illustrated in FIGS. 2–5, is generally formed in a substantially annular configuration and includes a central opening formed therein. It should be understood, however, that top 230 could be formed in any number of geometric configurations and could be open or closed. Top 230 is preferably formed in two pieces including a first portion 230*a* and a second portion 230*b*. First portion 230*a* and second portion 230*b* are coupled together using a pivot lock assembly 232, which is used to lock the first portion 230*a* into either a horizontal position or an upright position as will be described in more detail below. The pivot lock assembly 232 can be made using any well-known releasable locking mechanism, such as a locking ratchet mechanism or the like.

As noted above, the pivot lock assembly 232 allows the first portion 230*a* to be moved or rotated from a substantially horizontal position or coplanar orientation relative to the second portion 230*b* (FIGS. 2, 3, and 5) to a substantially vertical position or a non-coplanar orientation relative to the second portion 230*b* (FIG. 4).

Figure 6:
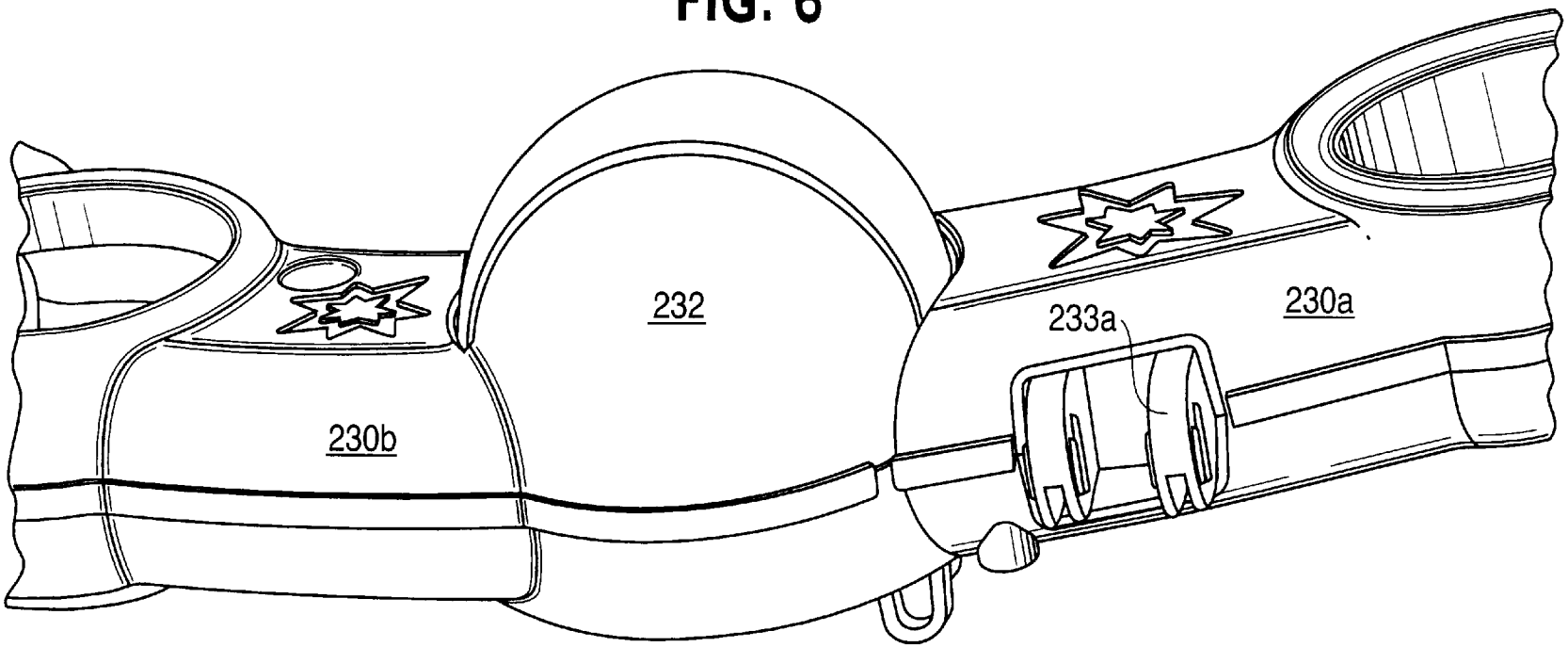
FIG. 6 is a detailed perspective view of an exemplary pivot lock assembly showing two positions of the release tab with the first portion of the top in a first configuration.
Figure 7:
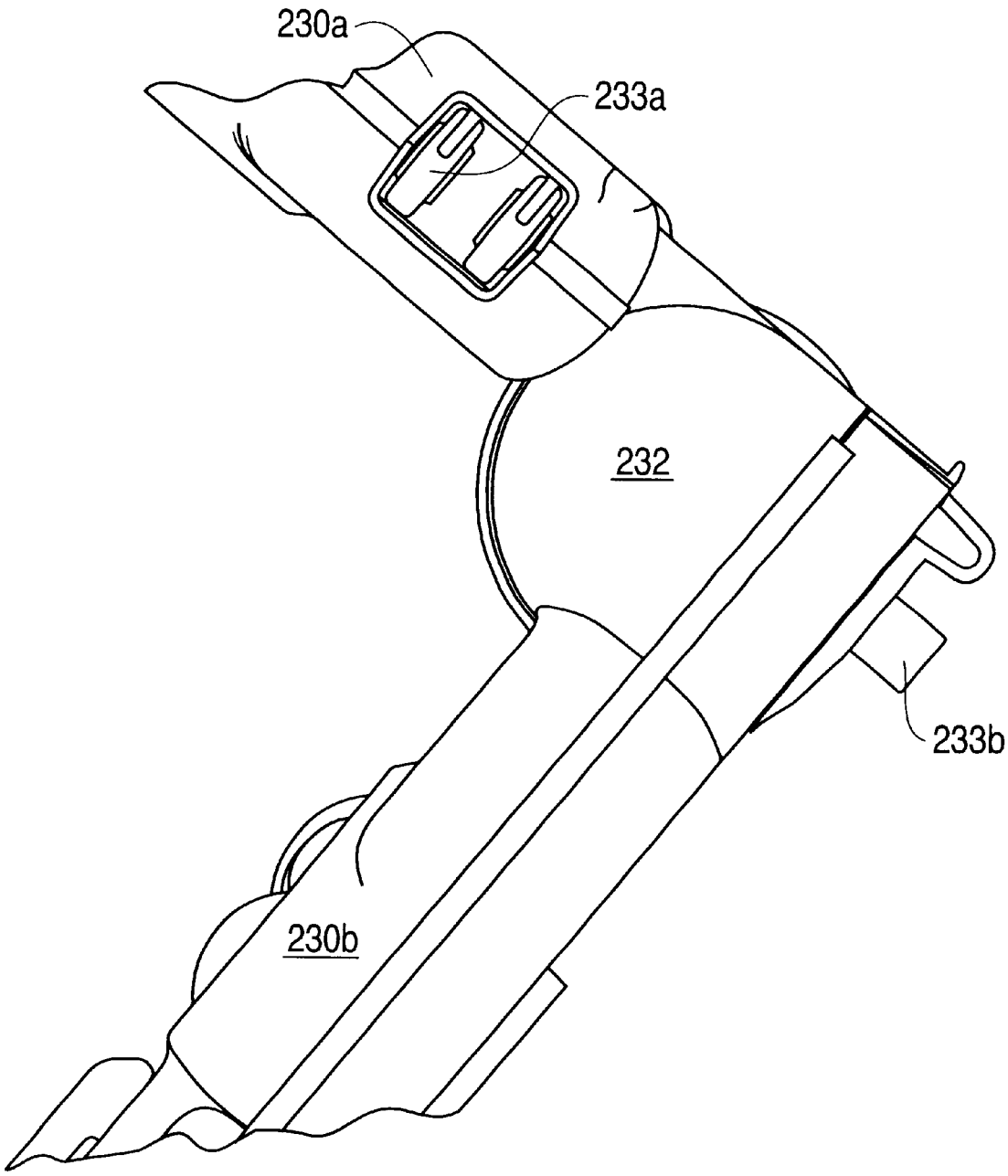
FIG. 7 is a detailed perspective view of the exemplary pivot lock assembly showing two positions of the release tab with the first portion of the top in a second configuration.

Referring to FIGS. 6 and 7, an exemplary pivot lock assembly 232 is shown. Pivot lock assembly 232 preferably includes a locking latch assembly 233. Latch assembly 233 preferably includes a tab 233*a* and a latch 233*b*. Latch assembly 233 is preferably spring-loaded so that the latch 233*b* always protrudes in an outwardly orientation as shown in FIG. 7. In order to move the latch 233*b* so that it is no longer in the outwardly orientation, a user, such as a parent, pulls or pushes tab 233*a* from a first position to a second position (each of the possible positions for tab 233*a* are shown in FIGS. 6 and 7). The movement of tab 233*a* causes latch 233*b* to move to a substantially inward orientation relative to the surface of pivot lock assembly 232.

For example, when first portion 230*a* is in the substantially horizontal position or coplanar orientation relative to second portion 230*b*, as shown in FIG. 6, latch 233*b* engages ribs (not shown) formed preferably in second portion 230*b*. Because the latch 233*b* is spring loaded in the normal outward position, first portion 230*a* cannot be moved until tab 233*a* is pulled or pushed from a first position to its second position. When the user pushes or pulls tab 233*a* to the second position, this disengages latch 233*b* from the ribs so that first portion 230*a* can be moved or rotated about the pivot lock assembly 232 and relative to second portion 230*b*.

When the first portion 230*a* is moved or rotated to the substantially vertical position or non-coplanar orientation relative to second portion 230*b* (as shown in FIG. 7), latch 233*b* engages a recess (not shown) preferably formed in one of the adjacent support columns 222 (not shown in FIG. 7). In order to move or rotate first portion 230*a* from the vertical position, the user pushes or pulls tab 233*a* from its first position to its second position. Again, both possible positions for tab 233*a* are shown in FIG. 7. When the user pushes or pulls tab 233*a* to the second position, this disengages latch 233*b* from the recess in support column 222 so that first portion 230*a* can be moved or rotated about the pivot lock assembly 232 and relative to second portion 230*b*.

In preferred embodiments, two pivot lock assemblies 232 are included. It should be apparent, however, that one, or more than two assemblies could be used.

As best illustrated in FIG. 3, when the first portion 230*a* is in the horizontal or substantially coplanar orientation, the top 230 and base 210 and/or support 220 define an opening and an interior space, which are proportioned to accommodate an infant or small child. In this configuration, an infant who is in the crawling stage can crawl through the opening and into the interior space to interact with the activity items disposed in a lower region of the toy 205 (as shown in FIG. 2 and which will be described in more detail below).

As illustrated in FIG. 4, first portion 230*a* can be moved or rotated, using the pivot lock assembly 232 in the manner described above, into a substantially vertical position or substantially non-coplanar orientation relative to the second portion 230*b*. In this configuration, the first portion 230*a* forms an arch configuration that allows a toddler or child that is in the walking stage to walk through the opening and into the interior space or a portion of the interior space. Such a configuration allows the toddler to interact with all the activity items disposed on the upper arch and the lower base or support portions. Such dual functionality and dual planar configuration enhances the child's enjoyment and thus prolongs the useful life of the toy.

Each of the preferred activity items included in toy 205 will now be discussed in detail. Top 230 includes an opening 235 formed on first portion 230*a* and dimensioned to allow an object, for example, a ball, to easily pass through therethrough. Opening 235 is preferably in communication with the opening 224 formed in the column 222 of support 220. As shown in FIGS. 3–5, top 230 preferably includes two openings 235. It should be apparent that any number of openings could be included.

Top 230 also preferably includes one or more sensory output generators, such as a plurality of lights 236 and a speaker, with a protective cover, 290 disposed therein. A preferred light for use with the present invention is a 4.5 volt, 100 mA bulb. Lights 236 are preferably disposed about the perimeter of top 230 in spaced-apart relation, however, lights 236 can be arranged in any configuration in top 230. Lights 236 can be provided with a plurality of different colored lenses to provide an array of colors when the lights are activated.

Top 230 further includes a plurality of actuators disposed therein and coupled to the activity items, as will be described in more detail below. Each of the actuators is operatively coupled in a well-known manner, through, for example, a micro-controller, to each of the sensory output generators, lights 236 and speaker 290, and operable to initiate operation of the lights 236 and speaker 290, in the manners described below. The actuators can include any well-known switch or micro-switch which are well known to one of ordinary skill in the art.

A rotating ring assembly 234 is preferably disposed on the second portion 230*b* of top 230. Rotating ring assembly 234 includes an opening formed therein and in communication with an opening (not shown) formed through second portion 230*b*. The opening is dimensioned to allow the passage of an object, such as a ball as illustrated in FIGS. 2 and 5, through the opening formed in top 230 and into ball exchanger 285, as discussed above. In preferred embodiments, ring assembly 234 includes an actuator which blocks passage of the object through ring assembly 234 until the child user rotates the ring assembly 234. As the ring assembly 234 is rotated, the actuator is moved out of the opening thereby allowing passage of the object. At the same time, the actuator activates an associated switch, which in preferred embodiments is a leaf spring, which sends an input to a micro-controller and the micro-controller then provides an output to one or both of the lights 236 and speaker 290. In preferred embodiments, the lights 236 and speaker 290 are actuated in a predetermined sequence.

Top 230 further includes a dial 238 as shown in FIGS. 2 and 5. Dial 238 freely turns in a clockwise or counter clockwise direction and triggers two switches (not shown) dependent upon the direction and speed of rotation of dial 238. For example, if dial 238 is turned counter clockwise, one of the two switches is activated and sends a signal to one or both of the lights 236 and speaker 290, which are activated in a particular predetermined sequence. Alternatively, if dial 238 is turned clockwise, the other of the two switches is activated and that switch sends a signal to one or both of the lights 236 and speaker 290, which are activated in a particular predetermined sequence. In preferred embodiments, the speed with which the dial 238 is turned will determine the speed of the music or other audible output of the speaker 290.

The top 230 also includes a spinning disc or drum 237 which also activates an associated actuator or switch that results in a signal being sent to one or both of the lights 236 and speaker 290. In preferred embodiments, each ⅙ rotation of the spinning disc or drum 237 activates the switch so that the lights 236 and speaker 290 are actuated. While the drum is turning, there is a continuous sequence of complete sound effects and lights flashing in a desired pattern. Exemplary sound effects include a spring, slide whistle up, slide whistle down, child's laugh, or the like.

As shown in FIGS. 4 and 5, in preferred embodiments, the top 230 includes a hanging ball 239 or other similar object that is attractive to the child user. In preferred embodiments, the top 230 includes at least two areas where the ball 239 or similar object may be disposed. Referring to FIG. 4, the ball 239 may be disposed in the center of the arch formed by first portion 230*a* of the top 230. Referring to FIGS. 3 and 5, the ball 239 may be disposed in one side of the first portion 230*a*. In either location, the ball 239 or similar object is coupled to an actuator that in turn is coupled to a micro-controller that provides an output to one or both of the lights 236 and speaker 290. A preferred actuator for use in preferred embodiments of the present invention is a leaf spring-type switch that is well known to one of ordinary skill in the art. A particularly preferred actuator is a 1P1T leaf-spring assembly switch. In preferred embodiments, the lights 236 and speaker 290 are actuated in a predetermined sequence when the ball 239 actuates the actuator. The dual location configuration allows an infant to play with the ball 239 when the infant is in the crawling stage and also allows the toddler to play with the ball 239 when the first portion 230*a* is rotated into the vertical position.

The top 230 can also include a plurality of gripping regions (which may also be referred to as grips or handles) disposed on top 230. For the sake of brevity and clarity, gripping regions, grips, or handles will be referred to herein as grips. In preferred embodiments, the grips 250 are formed integrally as part of the rim or outer perimeter of the top 230, as best shown in FIG. 5. Grips can be formed separately, however, and disposed on the top 230 using any well-known method.

A sensor 255 is preferably disposed on the underside of top 230, and particularly the underside of first portion 230*a*. Sensor 255 is configured to detect the presence of an infant or other user as the infant or other user crawls through the opening formed by the top 230, base 210, and support 220 and into the interior of the toy 205. In preferred embodiments, the sensor is a well-known light-sensing component, such as a cadmium sulfide photo-resistor, also known as a CdS cell. As the infant or small child crawls through the opening, the sensor changes its resistance based on the amount of light that hits the sensor. This change in resistance then sends a signal to a relay or accompanying transistor that sends a signal to a micro-controller to activate one or more of the sensory output generators.

In preferred embodiments, the sensor 255 is only activated when the first portion 230*a* is in the. horizontal position or substantially coplanar orientation relative to the second portion 230*b*. It should be understood however that the sensor could be operative at all times. Further, it should also be apparent that although a CdS cell is a preferred sensor any well-known sensor capable of detecting an infant passing through the opening can be employed in the present invention.

An operation mode selector is also disposed on the underside of top 230. In preferred embodiments, the operation mode selector is implemented as a three-position switch, which has a first position corresponding to off, a second position corresponding to the first portion 230*a* of top 230 being in the horizontal or coplanar orientation, and a third position corresponding to the first portion 230*a* of top 230 being in the vertical or non-coplanar orientation position. In an alternative embodiment, the mode can be determined directly by the position of the first portion 230*a* of top 230 without the need for an operation mode selector. In addition, top 230 also includes a cover plate (not shown) disposed over an opening formed in the top. A battery or batteries of a type well known in the art is/are preferably disposed in the opening under the cover plate.

Unless otherwise indicated herein, it is to be understood that the component parts of the present invention are preferably made from a polymer material, which is sufficiently durable and safe for use with infants and children of toddler age.

Having described the structural features of the disclosed embodiments, attention will now be given to their operation. A young child or infant can enter the activity center via crawling through the opening formed by the top 230, base 210 and support 220 as illustrated in FIG. 3. In this position, the infant can place objects, such as balls, in the track and watch as they roll down the track, pass through the exchanger, and pass through to the supporting surface. As noted above, the infant can also play with the hanging ball 239, spin the nose associated with the graphical image on the exchanger 285, or play with the mirror 280, among other activities.

In order to transition from the crawling or seated position to the standing position, the infant or toddler can grasp one of the grips 250 disposed on the support 220 and/or the top 230 and pull themselves up into a standing position. The infant's weight will be supported by the construction of the device as described above. Once in the standing position, the infant user can interact with the additional activity items described in detail above disposed at the top 230. Moreover, if the first portion 230*a* is rotated from the horizontal position or coplanar orientation relative to the second portion 230*b* to the vertical position or non-coplanar orientation relative to the second portion 230*b*, the toddler can walk into the interior space or a portion thereof and play with the activity items disposed on the arch formed by the first portion 230*a*, including but not limited to the ball as described above.

The additional features disposed at the top 230, including the sensory output generators, the spinning discs, dial, and the plurality of openings for the infant to place balls through, encourage the infant to transition from the seated to the standing position. The sturdy construction of the grips 250 incorporated into the support 220 and the grips which can be disposed on the top 230 facilitate the transition from the seated position to the standing position.

As the infant interacts with the toy, the infant is encouraged and enticed, through the combination of lights, sounds, and visual effects of the balls rolling down the track to make the transition from the seated position to the standing position by using the plurality of grips to pull himself or herself up into the standing position. Therefore, the present invention not only provides an activity center that directly promotes gross motor development but it also provides an efficient toy that can be used simultaneously by an infant and toddler while providing a high level of amusement to both.

The various features of the invention have been described in relation to a toy. However, it will be appreciated that any of the features, such as the base, support, plurality of grips, and top activity area, for example, can be used on a child's physical therapy treatment device, and the features described are not limited to use on toys. Moreover, variations and modifications exist which would not depart from the scope of the invention.

For example, although the preferred embodiments have been illustrated as generally circular, various other geometric configurations are possible, for example, triangular, rectangular, and cubic. In addition, although illustrated with a top movable between horizontal and vertical, the top could have intermediate positions between vertical and horizontal. Further, even though the top is shown as coupled and pivotable, the top could attach and reattach in alternate orientations.

What is claimed is:

1. A toy comprising:

a base receivable on a supporting surface, said base having an upper end, a lower end, and a pathway configured to guide an object from said upper end of said base to said lower end of said base;

a top coupled to said base, said top including a first portion and a second portion, said first portion movable from a substantially coplanar orientation relative to said second portion to a substantially non-coplanar orientation relative to said second portion, said first portion being pivotally coupled to said second portion, said top including a first opening defined therein, said first opening being in communication with said pathway on said base; and an activity item disposed on one of said base and said top.

2. The toy of claim 1, wherein said top and said base define a second opening and an interior space therebetween, said second opening having a first configuration that allows a child to crawl through said second opening and into said interior space when said top is in said substantially coplanar orientation, said second opening having a second configuration that allows a child to walk through said second opening and into a portion of said interior space when said top is in said substantially non-coplanar orientation.

3. The toy of claim 2, wherein said activity item is coupled to said top and located so that a child in said interior space may interact with said activity item.

4. The toy of claim 2, further comprising:

a sensory output generator; and an actuator operatively coupled to said sensory output generator and operable to initiate operation of said sensory output generator.

5. The toy of claim 4, wherein said actuator is actuated when a child passes through said second opening.

6. The toy of claim 4, wherein said sensory output generator generates at least one of a visible output and an audible output.

7. The toy of claim 4, wherein said actuator comprises a ball.

8. The toy of claim 1, wherein said top has a substantially annular configuration such that said first portion forms an arch configuration when said first portion is moved to said substantially non-coplanar orientation.

9. The toy of claim 1, wherein said first portion is pivotable about an axis lying in a common plane between said first portion and said second portion.

10. A toy comprising:

a base receivable on a supporting surface;

a support coupled to said base and extending upwardly therefrom, said support having an upper end and a lower end, said support including a first column and a second column, each of said first column and said second column extending from proximate to said upper end to proximate to said lower end;

a top coupled to said support, said top including a first portion and a second portion, said first portion being disposable in a first, substantially coplanar orientation relative to said second portion and in a second, substantially non-coplanar orientation relative to said second portion, said second portion being fixedly coupled to said support proximate to said upper end of said support, said first portion being pivotally coupled to said second portion; and an activity item disposed on one of said base, said support, and said top.

11. The toy of claim 10, wherein said top, said base, and said support define an opening and an interior space therebetween, said opening having a first configuration that allows a child to crawl through said opening and into said interior space when said top is in said substantially coplanar orientation, said opening having a second configuration that allows a child to walk through said opening and into a portion of the interior space when said top is in said substantially non-coplanar orientation.

12. The toy of claim 11, wherein said activity item is coupled to said first portion of said top, said activity item being disposed so that a child can interact with said activity item while entering said opening.

13. The toy of claim 10, wherein said base and said support further define a pathway for guiding an object from an upper end of said support to said base.

14. The toy of claim 13, wherein said top further comprises an opening formed therein and in communication with said pathway.

15. The toy of claim 11, further comprising:

a sensory output generator; and an actuator operatively coupled to said sensory output generator and operable to initiate operation of said sensory output generator.

16. The toy of claim 15, wherein said actuator is actuated when the child passes through said opening.

17. The toy of claim 15, wherein said sensory output generator generates at least one of a visible output and an audible output.

18. The toy of claim 15, wherein said actuator is a ball.

19. The toy of claim 10, wherein said top has a substantially annular configuration such that said first portion forms an arch configuration when said first portion is moved to said substantially non-coplanar orientation.

20. The toy of claim 10, wherein said first portion is pivotable about an axis lying in a common plane between said first portion and said second portion.

21. A convertible activity center comprising:

a body portion including a base receivable on a supporting surface and a top rotatable from a substantially horizontal position to a substantially vertical position, said top and said base defining an interior space therebetween and an exterior space, said base further including an opening through which a child can pass between said interior space and said exterior space;

a plurality of activity items disposed on said body portion and arranged so that the child may interact with said activity items by one of crawling through said opening into said interior space and walking through said opening into a portion of said interior space;

a sensory output generator; and an actuator operatively coupled to said sensory output generator and operable to initiate operation of said sensory output generator, said actuator being configured to be acutated when a child passes through said opening.

22. The convertible activity center of claim 21, wherein said body portion further includes a pathway for guiding an object from an upper end of said body portion to a lower end of said body portion.

23. The convertible activity center of claim 21, wherein said sensory output generator generates at least one of a visible output and an audible output.

24. The convertible activity center of claim 21, wherein said actuator comprises a ball.

25. An activity center comprising:

a base receivable upon a supporting surface;

a top having a general annular configuration and being coupled to said base, said top having a first portion and a second portion, said first portion being pivotally coupled to said second portion, said first portion of said top being rotatable relative to said second portion from a first position to a second position to form an arch configuration with respect to said second portion, said first portion and said second portion being substantially coplanar when said first portion is in said first position; and a plurality of activity items disposed on one of said base and said top and configured for engagement by a child, and wherein said top and said base define a child play area, said child play area being configured so that a child can be located in said child play area in one of a standing position and a seated position.

26. The activity center of claim 25, wherein said base further includes a pathway for guiding an object from an upper end of said base to a lower end of said base.

27. The activity center of claim 26, wherein said top further comprises an opening formed therein and in communication with said pathway.

28. The activity center of claim 25, further comprising:

a sensory output generator; and an actuator operatively coupled to said sensory output generator and operable to initiate operation of said sensory output generator.

29. The activity center of claim 28, wherein said actuator is actuated when the child engages one of said plurality of activity items.

30. The activity center of claim 28, wherein said sensory output generator generates at least one of a visible output and an audible output.

31. The activity center of claim 28, wherein said actuator comprises a ball.

32. An activity center comprising:

a base receivable upon a supporting surface;

a support coupled to said base and extending upwardly therefrom;

a top having a general circular configuration and coupled to said support, a portion of said top rotatable from a first position to a second position to form an arch configuration; and a plurality of activity items disposed on one of said base, said support, and said top configured for engagement by a child, and wherein said top, said support, and said base define a child play area configured to accommodate the child in one of a standing or a seated position.

33. The activity center of claim 32, wherein said base and said support further include a pathway for guiding an object from an upper end of said support to said base.

34. The activity center of claim 33, wherein said top further comprises an opening formed therein and in communication with said pathway.

35. The activity center of claim 32, further comprising:

a sensory output generator; and an actuator operatively coupled to said sensory output generator and operable to initiate operation of said sensory output generator.

36. The activity center of claim 35, wherein said actuator is actuated when the child engages one of said plurality of activity items.

37. The activity center of claim 35, wherein said sensory output generator generates at least one of a visible output and an audible output.

38. The activity center of claim 35, wherein said actuator comprises a ball.

39. The toy of claim 1, wherein said pathway includes a first track section and a second track section, said toy further comprising:

an exchanger, said exchanger being coupled to said first track section and said second track section, said exchanger being configured to direct an object from said first track section to said second track section.

40. The toy of claim 39, wherein said opening in said top is in communication with said first track section, and said second track section is in communication with said pathway on said base.

41. The toy of claim 3, wherein said activity item is coupled proximate to a center of said first portion, said activity item extending downwardly from said first portion when said first portion is in said substantially coplanar orientation and in said substantially non-coplanar orientation, said activity item being disposed lower than said second portion when said first portion is in said substantially coplanar orientation, and said activity item being disposed higher than said second portion when said second portion is in said substantially non-coplanar orientation.

42. The toy of claim 15, wherein said actuator is operable when said first portion is in said first orientation, and said actuator is rendered inoperable when said first portion is in said second orientation.

43. The toy of claim 13, wherein said pathway extends between said first column and said second column.

44. The toy of claim 43, wherein said first column has an upper end, a lower end, and an opening proximate to said upper end, said first column opening being in communication with said pathway, said second column has an upper end, a lower end, and an opening proximate to its lower end, said second column opening being in communication with said pathway.

45. The toy of claim 10, wherein at least one of said first column and said second column includes a handle coupled thereto and said base is substantially U-shaped.

46. The convertible activity center of claim 21, further comprising:

a sensor, said sensor being coupled to said top and being operatively connected to said sensory output generator, activation of said sensor causing said sensory output generator to generate an output.

47. The convertible activity center of claim 46, wherein said top has a first portion and a second portion, said first portion being pivotably coupled to said second portion, said first portion being disposable in a first orientation substantially coplanar with said second portion and in a second orientation substantially perpendicular to said second portion.

48. The convertible activity center of claim 47, wherein said sensor is coupled to said first portion, said sensor being operable when said first portion is in said first orientation, and said sensor being rendered inoperable when said first portion is in said second orientation.

49. The activity center of claim 40, wherein said top includes a pivot assembly, each of said first portion and said second portion being coupled to said pivot assembly, said pivot assembly being configured to retain said first portion in said second position.

50. The activity center of claim 40, wherein said top includes a sensor coupled thereto, said sensor being disposed proximate to said opening, said sensor being configured to detect the passage of a user through said opening, said sensor being operable when said first portion is in said first position and being rendered inoperable when said first portion is in said second position.

51. The activity center of claim 34, wherein said support includes a first column and a second column, said first column having an upper end and an opening proximate to said upper end, said opening of said column being in communication with said pathway.

52. The activity center of claim 35, further comprising:

a sensor, said sensor being coupled to said first portion and being operatively connected to said sensory output generator, activation of said sensor causing said sensory output generator to generate an output, said sensor being operable when said first portion is in said first position, and said sensor being rendered inoperable when said first portion is in said second position.

53. An infant activity toy having multiple configurations, said toy comprising:

a base, said base being configured to be disposed on a supporting surface;

a support, said support including a first column and a second column, each of said first column and said second column including an upper end and a lower end; and a substantially annular top, said top including a first portion and a second portion, said second portion being fixedly coupled to said support, said first portion being arch-shaped and having a first end and a second end, said second portion being arch-shaped and its own first end and second end, said first end of said first portion being pivotally coupled to said first end of said second portion, said second end of said first portion being pivotally coupled to said second end of said second portion, said first portion being selectively positionable in a first orientation and in a second orientation relative to said second portion, said first portion being substantially coplanar with said second portion in said first orientation, said first portion being substantially perpendicular to said second portion in said second orientation, said first portion and said base defining an opening therebetween, said opening having a first configuration when said first portion is in said first orientation so that a child may crawl through said opening, said opening having a second configuration when said first portion is in said second orientation so that a child may walk through said opening, said second configuration being larger than said first configuration, an a portion of said opening having an arch shape defined by said first portion.

54. The infant activity toy of claim 53, wherein said first column includes an upper end, a lower end, and an opening disposed proximate to said upper end, said second column including an upper end, a lower end, and an opening disposed proximate to its lower end, said support including a pathway extending between said first column opening and said second column opening.

55. The activity center of claim 54, further comprising:

a sensory output generator; and a sensor, said sensor being coupled to said first portion and being operatively connected to said sensory output generator, activation of said sensor causing said sensory output generator to generate an output, said sensor being operable when said first portion is in said first position, and said sensor being rendered inoperable when said first portion is in said second position.

* * * * *

UNITED STATES PATENT AND TRADEMARK OFFICE

CERTIFICATE OF CORRECTION

PATENT NO. : 6,540,579 B1 
DATED : April 1, 2003
INVENTOR(S) : Domenic T. Gubitosi, Seth P. Frankel and Christopher D. Cimerman It is certified that error appears in the above-identified patent and that said Letters Patent is hereby corrected as shown below:

Column 13,
Lines 65-67, change "a child play area configured to accommodate the child in one of a standing or" to -- a child play area, said child play area being configured so that a child can be located in said child play area in one of a standing position and --.

Signed and Sealed this

Twenty-first Day of October, 2003

JAMES E. ROGAN
*Director of the United States Patent and Trademark Office*